United States Patent [19]

Müller

[11] Patent Number: 4,925,440

[45] Date of Patent: May 15, 1990

[54] APPARATUS FOR THE WINDING OF CONTAINER JACKETS

[75] Inventor: Berthold Müller, Süssen, Fed. Rep. of Germany

[73] Assignee: Michael Hörauf Maschinenfabrik GmbH & Co. KG, Donzdorf, Fed. Rep. of Germany

[21] Appl. No.: 309,259

[22] Filed: Feb. 13, 1989

[30] Foreign Application Priority Data

Mar. 23, 1988 [DE] Fed. Rep. of Germany ..... 3809757

[51] Int. Cl.[5] ..... B31B 1/52

[52] U.S. Cl. ..... 493/466; 493/269; 493/295; 493/465; 493/152

[58] Field of Search ..... 493/269, 295, 465, 466, 493/152, 395

[56] References Cited

U.S. PATENT DOCUMENTS

| | | | |
|---|---|---|---|
| 369,638 | 9/1887 | Godfrey et al. | 493/466 |
| 2,473,275 | 6/1949 | Brouns | 53/584 |
| 2,942,530 | 6/1960 | Bodendoerfer | 493/154 |
| 3,603,220 | 9/1971 | Myers | 493/269 |
| 4,349,345 | 9/1982 | Bodendoerfer | 493/295 |
| 4,655,738 | 4/1987 | Jansson | 493/466 |

FOREIGN PATENT DOCUMENTS

85/01692 4/1985 World Int. Prop. O. .

*Primary Examiner*—Frederick R. Schmidt
*Assistant Examiner*—Jack Lavinder
*Attorney, Agent, or Firm*—Burns, Doane, Swecker & Mathis

[57] ABSTRACT

An apparatus for the making of container jackets from flat cardboard or plastic blanks. The blank is folded around a core by means of pivoted fingers which are moved toward the core while ends of the fingers are guided in guide passages to produce pivoting of the fingers. The fingers pivot such that blank-engaging ends of the fingers fold the blank around the core. The slide guides are mounted for pivotable movement simultaneously with the movement of the fingers toward the core, whereby the movement of the fingers can be adapted to cores of different diameter by changing the distance of movement of the carrier, i.e., the same fingers and slide guides can be used with an infinite number of core diameters.

14 Claims, 2 Drawing Sheets

APPARATUS FOR THE WINDING OF CONTAINER JACKETS

BACKGROUND OF THE INVENTION

The invention concerns an apparatus for the winding of container jackets wherein a flat blank of cardboard or plastic is bent around a winding core by means of a folding mechanism.

A conventional folding mechanism includes a pair of folding fingers each having first and second arm portions joined at a location where the respective fingers are pivotably mounted to a movable carrier. One of the arm portions carries a guidable member, and the other arm portion is engageable with the blank. A pair of slide guides are provided with curved (nonlinear) guide passages in which the guidable members are movably disposed. When the carrier is raised toward the core, the guidable members travel along the guide passages, causing the fingers to pivot such that their blank-engaging ends converge to fold the blank around the core.

In an apparatus of this type, such as shown in International Application WO 85/01692, the slide guides are stationary. Consequently, the slide guides and folding fingers controlled by the slide guides are adapted for use with only one size of winding core. Therefore, if a winding core is replaced by a core with a different diameter, at least the slide guides must also be replaced by guides of different configuration, because the folding fingers will have to be displaced to a different geometric position in order to fold the blank.

OBJECTS AND SUMMARY OF THE INVENTION

An object of the present invention is to eliminate this disadvantage and to provide slide guides suitable for use with more than one winding core diameter.

This object is attained in that the slide guides are pivotingly mounted and are pivoted in a controlled manner during the displacement of the pivot axles of the folding fingers.

It is possible in this manner to design the slide guides and to provide them with a drive such that the same folding fingers and the same slide guides may be used for different core diameters. It is merely necessary to alter the stroke of the folding fingers, which kinematically can be readily effected.

The invention is based on the discovery that in the winding of container jackets only the initial and terminal positions of the folding fingers must be defined exactly. The geometric movements of the folding fingers between these positions are of secondary importance and may be neglected within certain limits regardless of the core diameter. It is therefore not necessary to create specific movements of the folding fingers during the entire winding process as long as the initial and terminal positions are properly defined.

In a particularly advantageous embodiment of the invention, the slide guides are curved and controlled in such manner that elements guided by the slide guides move vertically at both the onset and the completion of the displacement stroke of the pivot axles. This configuration leads to a particularly simple drive of the slide guides, as in the initial stage the folding fingers merely follow the stroke without themselves being pivoted, while in the final stage, the pivoting motion of the slide guides occurs simultaneously with the movement of the stroke and ends with it, whereby adaptation to different diameters of the folding cores is obtained by simply changing the stroke length. The change in stroke length occurs during the final stage of the stroke.

Advantageously, the slide guides comprise two linear segments which, when viewed in the direction of motion, are acutely angled relative to each other, preferably at an angle of approximately 20°. The angled portions are joined (or intersect) with a proper smooth curvature to permit the guided elements to travel from one segment to the other.

The pivoting motion of the slide guides is initiated conveniently when the associated guided element has reached the junction of the segments. In this manner, the first linear stage of the stroke may be utilized essentially for a stroke distance which is common to all core sizes, while the second linear stage of the stroke is available for adaptation to the particular winding core size. The folding process thus begins, independently of the size of the winding core, always in the same initial position and only the terminal position is altered by adjusting the stroke length. This results in a particularly simple kinematics for the winding process.

Advantageously, the first linear stage of the stroke defined by the first segment of the slide guide can be of a length corresponding to the longest possible stroke for known core sizes. The second linear stage, on the other hand, would be essentially of a length corresponding to the difference of the smallest and the largest radius of the winding cores to be used.

The axle of the winding core may, independently of the diameter, remain in a constant position. This results in the advantage that aside from the adjustment of the stroke of the folding fingers, it is not necessary to adjust the position of the winding core also.

Advantageously, the blank may be provided prior to the winding around the winding core with a support, the distance of which to the axle of the winding core is constant, independently of the diameter of the latter. This again leads to a further simplification of the kinematics, as it is not necessary to alter the initial position of the blanks in order to adapt them to different winding core sizes. The support may comprise two folding plates and a contact pressure strip. The support for the blanks then assumes another function, i.e., part of the folding mechanism. The blanks are folded by the folding plates and the contact strip around the lower half of the winding core, while the controlled folding fingers subsequently fold the blanks around the upper half of the winding core.

In a simple manner, the folding plates may be displaceable parallel to the pivoting axles of the folding fingers and be spaced apart from each other in keeping with the diameter of the winding core in use including any tolerance. In the course of the transition to another diameter of the winding core, the folding plates are conveniently replaced by plates with different dimensions.

The contact pressure strip may be biased by a spring which yields when initial contact is made between the pressure strip and the core. In this manner, the contact strip may be controlled simultaneously with the folding plates, wherein the fact that the contact strip at one time will come to rest against the winding core which is acting as a stop, is taken into account since the strip may move relative to the folding plates when the spring yields.

The two slide guides may be controlled differently in time relative to each other and/or may have different geometric configurations so that the ends of the blank are not brought to their final positions simultaneously. This is necessary if the blanks are folded around the winding core in a fashion such that their terminal areas are to overlap. In such a case, the folding process of the folding fingers must be completed a different times.

BRIEF DESCRIPTION OF THE DRAWING

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
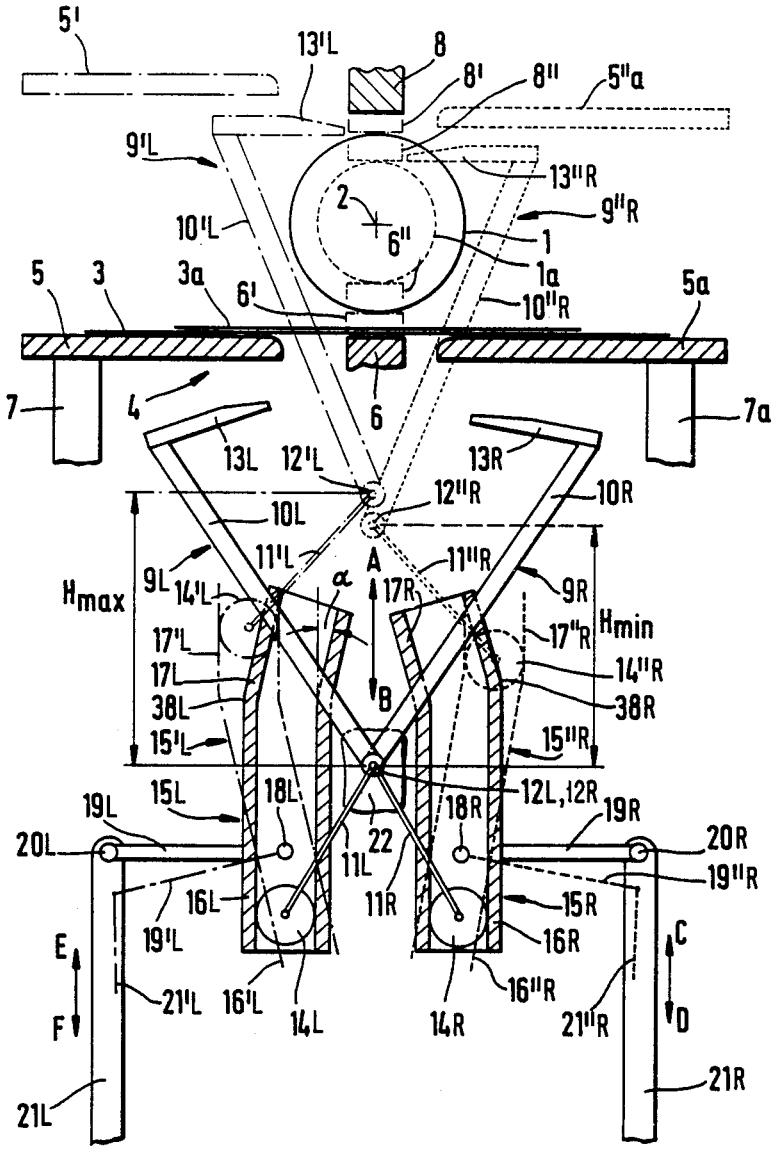
FIG. 1 is a side elevational schematic view of an apparatus according to the invention, in which the folding elements are depicted in their two extreme positions in solid and broken lines, respectively, with the left side of the drawing depicting folding elements correlated with a core of maximum diameter, and the right side of the drawing depicting folding elements corresponding to a core of smallest diameter.

In FIG. 1, the initial position of a folding mechanism is shown by solid lines, while a terminal position thereof is indicated by dotted or dash-and-dot lines. In the left side of the drawing, the folding (i.e., diameter) elements which are correlated with the largest format to be used have their terminal position indicated by dash-and-dot lines. The reference numerals indicative of the terminal positions are provided with a "prime" designation.

In the right side of FIG. 1 the folding elements corresponding to the smallest folding format are shown. The reference numerals used here are provided with a suffix "a". The initial position is drawn with solid lines and the terminal position by dotted lines. In addition to the suffix a, the reference numerals associated with the terminal position are provided with a "prime" designation.

In FIG. 1, thus, a winding core 1 with the largest diameter to be used, and as an alternative, a winding core 1*a* with the smallest diameter to be used are both shown. The two winding cores 1, 1*a* to be used have the same longitudinal axis 2, the position of which remains constant within the apparatus for both formats.

A flat blank 3, already introduced into its initial position and optionally comprising cardboard or a plastic is wound around the winding core 1 in a manner to be described below. A blank 3*a* of a smaller format is also shown which, after a resetting of the winding core, is to be wound around the winding core 1*a*. The initial position of the blanks 3 or 3*a* relative to the axle 2 of the winding core 1 or 1*a* remains constant.

A support 4 which is used to align the blanks 3 (or 3*a*) prior to the winding comprises two folding plates 5 (or 5*a*) and a contact pressure strip 6. Two folding plates 5 (only one being depicted) would be used if a large-diameter core 1 is employed, whereas two folding plates 5*a* would be used if a small-diameter core 1*a* is employed. That is, the plates 5*a* are sized to extend closer to the axle 2 than the plates 5. Both types of plates 5, 5*a* are depicted in FIG. 1 to show the relationship thereof with the two different size cores. In practice, the plates 5 and 5*a* would never be used together. The folding plates 5 (or 5*a*) are always identical, the size thereof depending on which winding core 1 or 1*a* is being used.

The contact strip 6, which remains the same for all winding core diameters, is raised and lowered together with the folding plates 5 (or 5*a*). However, the contact strip 6 is spring biased such that the spring can yield as the contact strip contacts the winding core 1 (or 1*a*), at a time when the folding plates 5 (or 5*a*) have not yet completed their stroke. The folding plates 5 (or 5*a*) are mounted on lifter rods 7 (or 7*a*), which are connected with a mechanism (not shown) to raise and lower the folding plates 5 (or 5*a*) together with the contact strip 6. The motion of the stroke takes place in the direction of the double arrow A–B; the kinematics of such movement are described later with reference to FIG. 2.

In the course of their upward stroke in the direction of the arrow A the folding plates 5 (or 5*a*) serve to fold the blank 3 (or 3*a*) around the lower half cylinder of the winding core 1 (or 1*a*). The folding plates 5 (or 5*a*) are thus moved into an upper terminal position 5' (or 5'*a*). During this stroke movement, the contact strip 6 comes to rest against the winding core 1 (or 1*a*), as indicated by the position 6' (or 6'*a*) of the contact strip 6.

Following the winding of the blank 3 (or 3*a*) around the lower half of the associated winding core 1 (or 1*a*), the blank is wound around the upper half of the core 1 (or 1*a*) by means of fingers 9 (or 9*a*) in a manner to be hereinafter discussed, such that the blank ends overlap. Then, a pressure piece 8 is applied to the overlapping ends of the winding core 1 (or 1*a*) in the direction B by means of a drive separate from that of strip 6. It is intended to provide enough pressure to ensure that the overlapping ends are welded or sealed. Depending on which winding core 1 (or 1*a*) is selected, the pressure piece 8 may assume a terminal position 8' (or 8'*a*).

In addition to the folding plates 5 (or 5*a*) and the contact pressure strip 6, the folding elements further include right-hand and left-hand folding fingers 9R, 9L which are used for all sizes of the winding cores. That is, it is not necessary to exchange the folding fingers 9R, 9L during resetting for winding cores of different diameter.

The folding finger 9L is in the form of a dual arm lever comprising two lever arms 10L and 11L fixedly connected with each other for common rotation and mounted pivotingly around an axle 12L located at a junction of the arms, in a manner described below. At its outer end, the lever arm 10L carries a foot 13L for engaging the blank to be folded. The right-hand folding finger 9R is identical with the left-hand folding finger and is formed by lever arms 10R and 11R which may be pivoted around an axle 12R. The lever arm 10R carries a foot 13R correlated with the blank 3*a*.

The folding fingers 9L, 9R are driven independently of each other relative to their control, i.e., their pivoting motions are not exactly congruent. This is due to the fact that the blank ends must overlap in the area of the pressure piece 8 and therefore the folding fingers 9L, 9R cannot be applied simultaneously to both blank ends.

The free end of the lever arm 11L of the folding finger 9L is equipped with a guide element 14L in the form of a roller moving in a curving slide guide 15L. The slide guide 15L comprises two linear segments 16L and 17L, which intersect at a rounded corner 38L to form an acute angle of about 20°. The slide guide 15L is pivoted around an axle 18L and is fixedly connected with an actuating lever 19L. The lever 19L is articulated by a pin 20L onto a reciprocable tie rod 21L, which may be displaced in the linear direction of the arrows E and F by a suitable drive.

The right-hand slide guide 15R can be of identical configuration as the slide guide 15. As will be explained below, the purpose of the carrier 22 is to raise the folding fingers during an initial phase of the winding operation, and the function of the slide guides is to cause the folding fingers to rotate during a subsequent phase of the winding operation. The slide guides are actuated out-of-phase in order to cause the folding fingers to be rotated out-of-phase so that the ends of the blank are brought to their final position at different times to ensure that those ends become overlapped. The slide guides 15L, 15R are not replaced during resetting for winding cores of different diameter.

The slide guide 15L comprises linear segments 16L and 17L which at a location 38L intersect each other. The slide guide 15L carries a guide element 14L in the form of a roller on the lever arm 1L of the folding finger 9L. The slide guide 15L is pivoted around an axle 18L by means of a lever 19L connected by a pin 20L to a reciprocable tie rod 21L which rod is moved linearly in the direction of the arrows C and D. The right-hand slide guide 15R, which is of identical construction, receives the roller 14R of the right-hand folding finger 10R.

The axles 12L, 12R, the folding plates 5 (or **5*a*), and the pressure strip 6 are mounted on the carrier 22, only a portion of which is depicted. The carrier 22 is raised and lowered by a mechanism described later in connection with FIG. 2**.

THE OPERATION of the finger apparatus will now be explained, assuming that the large-diameter core 1 is being utilized to wind a large diameter jacket from blank 3. Thus, two folding plates 5 are used. The following description of the operation will be made with reference to the left-hand side of FIG. 1 because the illustration of the right-hand side of FIG. 1 pertains to the winding of a small-diameter jacket. It will be understood, however, that the right-hand folding finger 10R and the right-hand slide guide 15R function similarly, but out-of-phase, relative to the left-hand finger 10L and slide guide 15L during the winding of the large diameter jacket. Therefore, in the following discussion reference will be made to both fingers 10L, 10R and both guides 15L, 15R, but only the left-hand side of FIG. 1 should be referred to in order to view the position of those components during the winding of a large diameter jacket. The pivot axles 12L, 12R of the folding fingers 9L, 9R are initially located in their lowest position, i.e., the folding elements have been moved down in the direction B by the common carrier 22. The guide elements 14L, 14R are thus at the lower dead point of the slide guides 15L, 15R. When the upward stroke of the carrier 22 and thus of the folding elements in the direction A begins, the guides 15L, 15R (which do not rise) are not initially rotated. The guide elements 14L, 14R move upwardly in the vertically linear segments 16L, 16R in a direction parallel to the direction A–B, approximately into the area of the curves 38L, 38R, and the folding fingers therefore retain their position shown in solid lines (depicted in the let-hand side of FIG. 1) and travel vertically past the largediameter winding core 1 while the two folding plates 5 are bending the blank around the lower half of the core. At this moment (i.e., when the guide elements 14L, 14R reach the curves 38L, 38R), the pivoting motion of either one of the slide guides 15L, 15R begins, due to the pull of the associated tie rod 21 in the direction F. It will be assumed for purposes of this explanation that the left-hand slide guide 15L begins to pivot prior to the right-hand slide guide 15R). The end of the pivoting motion of the left-hand slide guide 15L is shown by dash-and-dot lines. The slide guide 15L assumes the position 15'L, while the tie rod 21L moves into the position 21'L. Since the movement of carrier 22 in the direction A is simultaneously occurring with the pivoting motion of the slide guide 15L, the guide element 14L finally arrives in its terminal position 14'L. The pivoting motion of the slide guide 15L into the position 15'L produces a pivoting of the folding finger 9L around the pivot axle 12L (as the guide element 14L travels in the segment 17L), until the foot 13L thereof occupies the position 13'L.

The pivoting of the right-hand slide guide 15R is initiated by its tie rod 21R shortly after the pivoting of the left-hand slide guide 15L has begun. In that way, the movement of the folding finger 9R of the right-hand slide guide 15R slightly trails that of the left-hand finger to enable to ends of the blank to be overlapped, i.e., the end of the blank 3 folded by the right-hand (i.e., trailing) folding finger 9R will overlie the end folded by the left-hand (i.e., leading) folding finger 9. Accordingly, the blank will have been wrapped or wound completely around the core.

The folding process in the case of the smaller winding core **1*a* takes place correspondingly, except that the terminal positions of the feet 13L, 13R is not as high, as will be appreciated from a comparison of the terminal position 13''R of the right-hand foot after folding a small-diameter jacket with the position 13'L of the left-hand foot after folding a large diameter jacket. (The double-prime symbols for the reference numerals signifies a terminal position of the components when winding a small diameter jacket, whereas the single-prime symbols signify a terminal position when winding a large diameter jacket.) This is achieved by raising the carrier 22 by a shorter stroke $H_{min}$ as compared with the longer stroke $H_{max}$ for winding a large-diameter jacket. It will be appreciated therefore that the difference in stroke length required by the different winding cores 1 and 1*a* corresponding to the dimensions $H_{max}$ and $H_{min}$ occurs essentially in the linear segments 17L, 17R of the slide guides 15L and 15R. That is, the carrier 22 is raised by different distances depending upon the core size, i.e., when smaller diameter core la is used, the carrier is raised by a distance which is shorter by $H_{max}-H_{min}$ as compared to the use of a larger diameter core. Importantly, however, in both cases, after the completion of the pivoting motion of the slide guides, the linear segments 17L or 17R** are oriented vertically.

When the apparatus is reset from a larger diameter winding core 1 to a smaller diameter winding core **1*a*, the folding fingers 9L, 9R and the slide guides 15L, 15R are retained. As mentioned above, only the folding plates 5 need to be replaced with folding plates 5*a*. The initial positions of the pivot axles 12L, 12R remain unchanged; only the terminal positions thereof change. If the apparatus is to be reset to a different winding core, it is necessary only to alter the vertical stroke of carrier 22**.

Due to the out-of-phase travel of the folding elements 9L, 9R, the geometric curves described by those folding elements during upward travel are not identical. This, however, is immaterial and only the initial and the terminal positions must be defined accurately. In the intermediate areas it is unimportant at which exact point in time the blanks 3 and 3*a* are wound around the winding core 1 and 1*a*.

Figure 2:
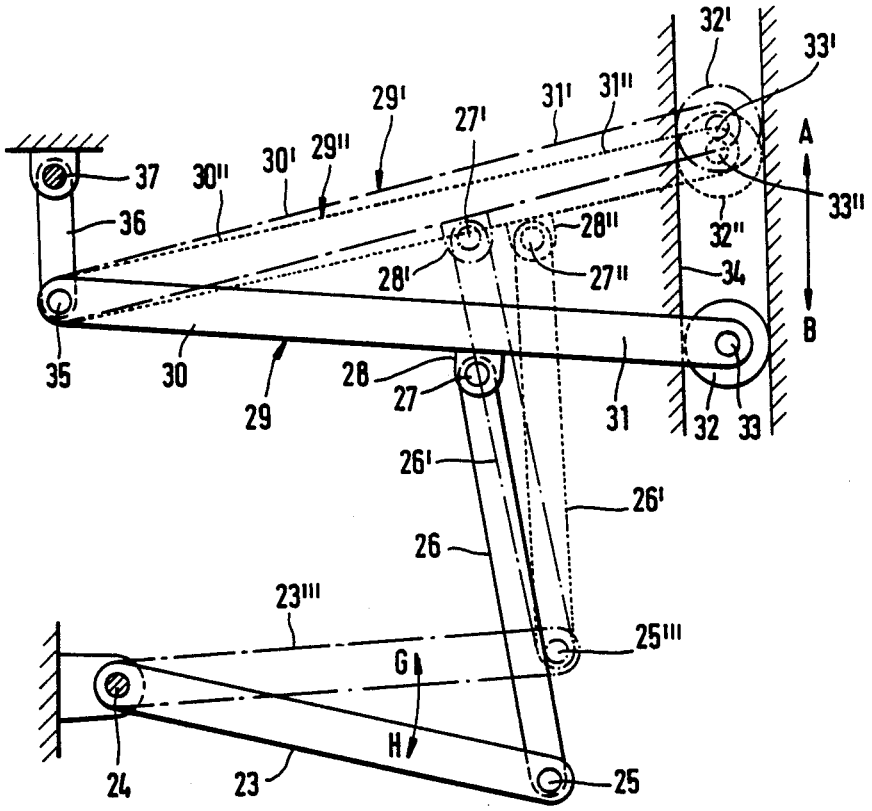
FIG. 2 is a schematic depiction of a mechanism for effecting a stroke of the folding mechanism and the manner in which the stroke length can be changed to adapt to different winding core diameters.

With reference now to FIG. 2, it can be seen that the stroke of both folding elements 9L, 9R generated by a common lever 23 pivoted around a stationary axle 24 in the direction of the arrows G and H. The lever 23 may be pivoted from a lower position into an upper position 23''' under the action of a cam plate (not shown). (The triple-prime symbol for the reference numerals designates a terminal position which is common for the winding of all jacket diameters.) The pivoting motion of the lever 23 is independent of the formats of the winding core 1 or 1*a*, it therefore is not altered in the resetting of the apparatus. This results in the fact that the same cam plate may be used with different strokes.

The free end of the lever 23 is articulated to a tie rod 26 whose other free end is articulated at 27 to a dual arm lever 29. The articulation 27 is located on an ear 28 which may be selectively displaced to different adjusted positions along the dual arm lever 29, whereby the lever 29 is divided into two lever arms 30 and 31. This creates a form of an articulated rectangle.

One lever arm 30 of the dual arm lever 29 is connected by means of a pin 35 with an arm 36 pivoted to a stationary axle 37. The other lever arm 31 of the dual arm lever 29 carries a roller 32 on an axle 33, which roller moves in a vertical slide guide 34 in the direction of the arrows A and B. The stroke of the roller 32 corresponds exactly to the stroke of the folding plate 5 (or 5*a*). The axle 33 can be operably connected to the carrier 22 to effect the vertical stroke thereof. The articulation of the dual arm lever 29 to the arm 36 is necessary as the roller 32 is guided not in a circular movement, but in a straight line. It is thus necessary to allow the other end of the dual arm lever 29 to move.

If the lever 23 pivots into the position 23''', the tie rod 26 moves into the position 26', taking the dual arm lever 29 into the position 29'. Due to the translation ratio of the lever arms 30, 31 of the dual arm lever 29, a stroke develops at the roller 32 which is larger than the distance of travel of the articulation 27.

If now it is necessary to reduce the stroke in an adaptation to a winding core 1*a* with a smaller diameter, the ear 28 is merely moved closer to the roller 32, as shown by the dotted line in position 28''. Due to the translation ratio of the lever arms 30 and 31, the roller 32 no longer occupies an upper position 32' but an upper position 32''. The stroke is thus adapted to different diameters of the winding core 1 or 1*a* by adjusting the ear 28. Alternatively, an elongated hole in the lever 29 in which a bolt on the tie rod 26 is adjustably displaced, can be used in place of the ear 28.

Obviously, any intermediate position may be set between the diameters of the winding cores 1 and 1*a*. The disclosed embodiment is merely described relative to the extreme positions. Thus, the apparatus according to the present invention can be adapted to an infinite number of core diameters.

Although the present invention has been described in connection with preferred embodiments thereof, it will be appreciated by those skilled in the art that modifications, additions, substitutions, and deletions, not specifically described, may be made without departing from the spirit and scope of the invention as defined in the appended claims.

What is claimed is:

1. Apparatus for making container jackets wherein a blank is folded around a winding core and pressed thereagainst, said apparatus comprising:

a carrier movable relative to the core;

folding means for folding the blank around the core including a pair of folding fingers mounted on said carrier for movement therewith, each folding finger pivoted to said carrier for rotational movement about an axis disposed transversely to the direction of movement of said carrier and including first and second arm portions, one of said arm portions carrying a guidable member and the other arm portion including blank-folding element;

a pair of slide guides mounted independently of said carrier, each slide guide having a nonlinear guide passage in which a respective one of said guidable members is movably disposed, each of said slide guides being pivotable about an axis disposed transversely relative to the direction of movement of said carrier;

means for moving said carrier such that said folding fingers approach the core along opposite sides thereof and said guidable members travel along said guide passages, and means for pivoting said slide guides during said movement of said carrier to produce rotation of said folding fingers such that said blank-folding elements of said fingers are displaced toward each other in a manner folding the blank around the core.

2. Apparatus according to claim 1, wherein each of said guide passages is configured such that the direction in which the respective one of said guidable members travels during a final stage of its movement is parallel to the direction of movement of said carrier.

3. Apparatus according to claim 2 including means for varying the distance of movement of said carrier such that said fingers are adapted to cores of different diameter.

4. Apparatus according to claim 3, wherein said core is oriented horizontally, said carrier moves vertically linearly, and said axes of said fingers and said slide guides are oriented horizontally.

5. Apparatus according to claim 2, wherein each of said guide passages comprises two non-aligned linear segments.

6. Apparatus according to claim 5, wherein said segments form a angle therebetween of about 20 degrees.

7. Apparatus according to claim 5, wherein said means for pivoting said slide guides comprises means for pivoting said slide guides when said guidable members reach the point of intersection of the associated segments of said guide passages.

8. Apparatus according to claim 1, wherein the axis of the core is stationary.

9. Apparatus according to claim 1 including means for varying the distance of movement of said carrier.

10. Apparatus according to claim 9, wherein the axis of the core is stationary, support means for supporting the blank, said support means being spaced from the axis of the core by a constant distance regardless of the distance of movement of said carrier.

11. Apparatus according to claim 10, wherein said blank supporting means comprises a pair of spaced apart folding plates and a pressing strip disposed in a space between said folding plates.

12. Apparatus according to claim 11, wherein said folding plates are spaced apart by a distance corresponding to the core diameter, said folding plates being movable parallel to said carrier.

13. Apparatus according to claim 12, wherein said pressing strip is spring-biased toward the core so as to be yieldable when contact is made with the core.

14. Apparatus according to claim 13, wherein said folding plates and said pressure strip are mounted on said carrier.

* * * * *